United States Patent [19]

White

[11] 4,311,567

[45] Jan. 19, 1982

[54] TREATMENT OF PERMIONIC MEMBRANE

[75] Inventor: Preston S. White, Corpus Christi, Tex.

[73] Assignee: PPG Industries, Inc., Pittsburgh, Pa.

[21] Appl. No.: 207,595

[22] Filed: Nov. 17, 1980

[51] Int. Cl.[3] ..... C20B 1/34; C28B 13/08

[52] U.S. Cl. ..... 204/98; 204/128; 204/180 P; 204/296

[58] Field of Search ..... 204/180 P, 98, 128, 204/296

[56] References Cited

U.S. PATENT DOCUMENTS

| | | | |
|---|---|---|---|
| 3,985,631 | 10/1976 | Hora et al. | 204/98 |
| 4,000,057 | 12/1976 | Mrazek et al. | 204/296 |
| 4,124,477 | 11/1978 | Tokawa | 204/252 |
| 4,148,979 | 4/1979 | Asami et al. | 521/27 |

*Primary Examiner*—R. L. Andrews

*Attorney, Agent, or Firm*—Richard M. Goldman

[57] ABSTRACT

Disclosed is a method of electrolyzing alkali metal chloride brine in permionic membrane cell where the permionic membrane is hydrolyzed in situ. The membrane is hydrolyzed by electrodialytically drawing alkali metal ions through the membrane. Thereafter, electrolysis is commenced.

4 Claims, No Drawings

TREATMENT OF PERMIONIC MEMBRANE

DESCRIPTION OF THE INVENTION

Chlorine and aqueous metal hydroxides may be industrially prepared in permionic membrane electrolytic cells. Permionic membrane electrolytic cells are characterized by the presence of a permionic membrane between the anolyte compartment and the catholyte compartment. The anolyte compartment, with a coated valve metal anode therein, contains an acidic, chlorinated brine anolyte, e.g., a sodium chloride brine anolyte or a potassium chloride brine anolyte. The catholyte compartment, on the opposite side of the permionic membrane, contains the cathode and an aqueous alkali metal hydroxide electrolyte, e.g., potassium hydroxide or sodium hydroxide.

The permionic membrane is a cation selective permionic membrane, that is, alkali metal ions, i.e., cations, such as potassium ion or sodium ion pass through the permionic membrane from the anolyte compartment to the catholyte compartment, while the passage of anions, i.e., chloride ions, from the anolyte compartment to the catholyte compartment, or hydroxyl ions from the catholyte compartment to the anolyte compartment, is substantially inhibited or eliminated by the cation selective groups of the permionic membrane.

Typically, the permionic membrane is a halogenated hydrocarbon, e.g., a fluorinated hydrocarbon, with pendant active groups. The pendant functional groups are anionic groups having cation selectivity, such as sulfonyl groups, phosphonyl groups, and carboxyl groups. Most commonly the pendant functional groups are either carboxyl groups or sulfonyl groups. The groups are either acid groups or groups which may be converted to acid groups.

The catholyte facing side of the permionic membrane is in the alkali metal salt form during electrolysis, that is, it is in the form of a sodium salt of a carboxyl acid, a potassium salt of a carboxylic acid, sodium salt of a sulfonyl acid, or a potassium salt of a sulfonic acid. The alkali metal salt form is not easily workable, being wet, strongly alkaline, and not readily heat-fusible or heat-sealable.

Preferably, the permionic membrane material is in a heat-sealable, hand-workable form when installed in the cell, for example, a low alkyl ester of carboxylic acid, or an acid halide of a carboxylic acid, a sulfonic acid, or a phosphonic acid.

The ester, acid halide, or hydrogen acid form of the permionic membrane must be hydrolyzed before electrolysis can begin. The hydrolysis may occur before fabrication, after fabrication but before installation in the cell, or after fabrication and after installation in the cell.

Hydrolysis in situ, that is, hydrolysis after fabrication and installation in the cell, offers various advantages. For example, it allows cell installation personnel to work with the ester form rather than the sodium salt or potassium salt form of the permionic membrane, and it allows the membrane to be dry, or if wet, to be wet with materials that do not require special handling. However, hydrolysis with one side contacting the brine and the other side contacting an alkaline solution, as catholyte, gives rise to problems such as blistering, high chlorate content in the result in the anolyte liquor, and the presence of high levels of impurities, as oxygen and hydrogen in the chlorine gas. It is, therefore, necessary to carry out hydrolysis in a manner so as to minimize the aforementioned problems.

It has now been found that in situ hydrolysis may be carried out by providing alkali metal chloride brine in the anolyte compartment and an electrolyte, as alkali metal hydroxide or water, in the catholyte compartment, and maintaining an electrodialytic electrical potential between the anode and the cathode in order to hydrolyze the permionic membrane. That is, an electrical potential is established between the anode and the cathode to acidify the anolyte liquor while maintaining the electrical potential low enough to avoid production of electrode product until the permionic membrane is substantially hydrolyzed, and preferably, reaches substantially constant values of electrical resistance.

DETAILED DESCRIPTION OF THE INVENTION

Applicant's invention relates to chlor-alkali electrolysis in a permionic membrane cell and particularly to a method of starting up the cell, that is, of readying the cell to commence electrolyis by hydrolysis of the permionic membrane.

Permionic membrane electrolytic cells are characterized by an anolyte compartment with an anode and anolyte liquor therein, a catholyte compartment with a cathode and catholyte liquor therein, and a permionic membrane therebetween. Typically, the anode is a coated metal anode having a valve metal substrate with a catalytic coating thereon. Chlorine is evolved at the anode according to the reaction:

$$Cl^- \rightarrow \tfrac{1}{2}Cl_2 + 1e^-$$

The anolyte liquor is the brine feed acidified and chlorinated within the cell. Typically, the brine feed is concentrated, even saturated brine, and may be acidic, neutral, or alkaline. Most frequently it is alkaline. The brine feed, typically contains about 4.5 to about 11 mole percent alkali metal chloride, that is, about 15 to about 26 weight percent sodium chloride, or about 17 to about 35 weight percent potassium chloride. The anolyte liquor typically has 25 to 75 percent brine depletion and is at a pH of from about 2.5 to about 5.5.

The catholyte compartment contains a metal cathode. It may optionally have a coating, such as nickel, lead oxide, or the like. Hydroxyl ion and, when an oxidant is not separately fed to the catholyte compartment, hydrogen, are evolved at the cathode. The catholyte liquor is an alkali metal hydroxide, substantially free of chlorine, and containing from about 5 to about 28 mole percent alkali metal hydroxide, i.e., from about 10 to about 45 weight percent sodium hydroxide, or from about 13 to about 55 weight percent potassium hydroxide.

Interposed between the anolyte compartment and the catholyte compartment is a permionic membrane. The permionic membrane is cation selective. That is, it has functional groups that block the flow of chlorine from the anolyte to the catholyte, and the flow of hydroxyl ion from the catholyte to the anolyte, while permitting the flow of cations, i.e., sodium ions or potassium ions. During normal electrolysis the flow of alkali metal ions is from the anolyte to the catholyte. Moreover, the permionic membrane maintains a pH differential between the anolyte liquor and the catholyte liquor, with the anolyte liquor having a pH of from about 2.5 to about 5.5 and the catholyte liquor containing from about 5 to about 28 mole percent alkali metal hydroxide.

In the permionic membrane electrolytic cell process for the production of chlorine and alkali metal hydroxide, brine is fed to the anolyte compartment and depleted brine is recovered therefrom, while either water or dilute alkali metal hydroxide is fed to the catholyte compartment, and concentrated alkali metal hydroxide, i.e., concentrated sodium hydroxide or potassium hydroxide is recovered therefrom. An electrical current passes from the anode to the cathode, evolving chlorine at the anode and hydroxyl ion and hydrogen at the cathode.

Chlorine gas is recovered from the anolyte compartment with aqueous alkali metal hydroxide, i.e., aqueous potassium hydroxide or sodium hydroxide, being recovered from the catholyte compartment.

The electrodes may be planar electrodes, as in a pancake type cell, or fingered, interleaved electrodes. The permionic membrane is supported by one electrode, most commonly by the cathode, although it may, alternatively, be supported by the anode. Alternatively, anodic electrocatalyst or cathodic electrocatalyst or both may contact the permionic membrane, as in a solid polymer electrolyte cell where electrocatalyst is bonded to the permionic membrane or in a zero gap permionic membrane cell wherein the anodic electrocatalyst or the cathodic electrocatalyst or both removably contact the permionic membrane. In a permionic membrane electrolytic cell having fingered electrodes, the permionic membrane is typically a sheet or plurality of sheets that are formed into the shape of the electrode surface upon which they are carried, i.e., formed into the shape of a fingered electrode and thereafter sealed to form an electrolyte-tight, gas-tight shaped structure. Typically the sealing is by heat-sealing.

Preferably, where fabrication of the membrane, including sealing is required, the membrane is in the acid, ester, or acid halide form. It may be dry, or swollen by suitable solvents as water, brine, or organic solvents such as alcohols, aldehydes, ketones, ethers, and esters.

When the membrane is installed in the cell, one side of the permionic membrane faces the anolyte compartment and the anode. The anolyte compartment contains cell body parts, including the anode, which may be harmed by concentrated, alkaline, alkali metal hydroxide solutions. The opposite side of the permionic membrane faces the catholyte and the cathode. The catholyte compartment body parts and the cathode may be harmed by anolyte liquor.

It is necessary to hydrolyze the permionic membrane from the hydrogen acid, ester, or acid halide form prior to commencing electrolysis. This is in order to avoid blistering, high anode gas oxygen and hydrogen content, and high anolyte chlorate contents during subsequent electrolysis. However, the hydrolysis must be carried out without subjecting the anolyte compartment to catholyte liquor or the catholyte compartment to anolyte liquor.

According to the invention herein contemplated, a low voltage, low current density electrodialysis current is passed across the cell. That is, the voltage is below the sum of the decomposition half-cell voltages of the anode and cathode reaction, including overvoltage, and the resistance of the electrolyte and permionic membrane. In this way, substantially no chlorine is evolved at the anode, and substantially no hydroxyl ion or hydrogen is evolved at the cathode. The voltage is, however, maintained high enough to provide electrodialysis through the permionic membrane.

The current density is maintained low enough to avoid voltages at which chlorine evolution or hydroxyl evolution takes place at the electrodes either in parallel with or in competition to the electrodialysis. The voltage is maintained under 2.6 volts, preferably under 2.5 volts, and for particularly satisfactory hydrolysis under about 2.4 volts, whereby electrodialysis is the preferred phenomena and electrolysis, that is, electrolytic evolution of product at the electrodes, is not preferred.

The voltage referred to herein as an electrodialysis voltage or an electrodialytic voltage is below the zero current density decomposition voltage, that is, below the sum of the zero current density half-cell voltages, the overvoltage and the voltage drop across the permionic membrane and across the electrolytes. However, the electrodialysis voltage should be high enough to provide acidification of the anolyte. The anolyte liquor is generally fed to the cell as a neutral to basic alkali metal chloride brine, which is electrodialytically acidified, i.e., reduced in pH from an initial value of about 8.1 or higher by at least about 0.3 pH units or more to a pH of 7.8 or less, and preferably to below pH 7. Generally, electrodialysis is carried out for 2 to 48 hours, although lesser or longer periods may be utilized, depending upon the electrodialysis current density. Dialysis, without electrically enhanced electrodialysis, may proceed electroldialysis, whereby to reduce the pH of the anolyte from the initial basic pH. The total time of dialysis plus electrodialysis should be such as to reduce the membrane resistivity, measured from current lead to current lead, from an initial value of millions of ohm-centimeters to a range of between about 100 to about 1000 ohm-centimeters and thereafter to a final range of less than about 7000 ohm-centimeters, i.e., from about 2100 to about 5000 ohm-centimeters.

As herein contemplated, an electrolytic cell having an anolyte compartment with an anode therein and a catholyte compartment with a cathode wherein and a cation selective permionic membrane therebetween is utilized in a process of electrolyzing alkali metal chloride brine, i.e., sodium chloride brine or potassium chloride brine to produce chlorine and the alkali metal hydroxide, i.e., sodium hydroxide or potassium hydroxide. The cation selective permionic membrane is a polymeric perfluorocarbon having pendant cation selective, acid groups, most commonly carboxylic acid groups. The cation selective acid groups are most commonly in the alkali metal salt form during electrolysis, i.e., the alkali metal carboxylate form, and the alkali metal sulfonate form, or the alkali metal phosphonate form. According to the method herein contemplated, the permionic membrane is initially installed in the permionic membrane electrolytic cell in a form other than the sodium salt or potassium salt form, i.e., in the hydrogen acid form, the acid halide form, or a low alkyl ester form. Thereafter, alkali metal chloride brine is provided to the anolyte compartment and an electrolyte, for example water, dilute potassium hydroxide or dilute sodium hydroxide, in the catholyte compartment. An electrodialytic electrical potential is maintained between the anode and the cathode whereby to hydrolyze the permionic membrane, i.e., until the membrane is substantially completely hydrolyzed. Thereafter, the electrical potential between the anode and the cathode is increased in order to initiate electrolysis. Typically, the electrodialytic electrical potential is maintained high enough to acidify the anolyte and low enough to avoid substantial electrolytic product evolution. That is, the electrodialytic electrical potential is maintained below the sum of resistance voltage drops across the electrolyte and permionic membrane, and the half cell voltages at the electrodes. Thus, an electrical potential is maintained between the anode and the cathode to acidify the anolyte liquor while maintaining the potential low enough to avoid production of electrode product until the permionic membrane is substantially hydrolyzed and thereafter the electrical potential therebetween is increased to initiate electrolysis. Hydrolysis may be monitored by monitoring the electrical resistance of the permionic membrane and continuing electroldialysis until the electrical resistance of the permionic membrane attains a substantially constant value.

In one exemplification of this invention, a zero gap permionic membrane electrolytic cell is assembled. By a zero gap permionic membrane electrolytic cell is meant that the anode electrocatalysts removably bears upon the anolyte facing surface of the permionic membrane, or the cathodic electrocatalyst removably bears upon the catholyte facing surface of the permionic membrane, or both removably bear upon opposite surfaces of the permionic membrane. The anodic electrocatalyst is a suitable anodic, chlorine evolution electrocatalyst, for example, ruthenium dioxide, ruthenium dioxide with rutile-form titanium dioxide, platinum with irridium, platinum, or an intermetallic oxycompound as a delafossite, a pyrochlor, or a spinel. The anodic electrocatalyst is bonded to a metallic, electroconductive substrate, as titanium screen, tantalum screen, tungsten screen or the like.

The cathodic electrocatalysts bears upon the catholyte facing surface of the permionic membrane. The cathodic catalyst may be a platinum group metal as platinum, platinum black, platinum irridium, or the like. Alternatively, it may be a transition metal as iron, cobalt, or nickel. Preferably it is a porous Group VIII as porous nickel. The cathode substrate may be iron, cobalt, nickel, copper or lead mesh or screen.

Preferably both the anode electrocatalyst and cathode electrocatalyst both bear upon a perfluorocarbon carboxylic acid permionic membrane. In the assembly of the cell, the membrane is in the ester form, e.g., the methyl or ethyl ester form of the carboxylic acid. The two halves of the cell are assembled with the membrane between them. Thereafter, sodium chlorine brine, containing, for example, from about 15 to about 25 weight percent sodium chloride is fed to the anolyte compartment and an electrolyte, for example, sodium hydroxide solution containing from about 2 to about 25 weight percent sodium hydroxide is fed to the catholyte compartment. An electrical potential of from about 2.4 to about 2.6 volts is imposed across the cell. This electrical potential is less than the combined electrode potentials, membrane voltage drop, and electrolyte voltage drop. This voltage is maintained while the membrane resistance is monitored. As the membrane resistance decreases from approximately 400 ohms per square centimeter to about 4 milliohms per square centimeter, the electrodialysis current density increases from about 25 amperes per square foot to about 200 amperes per square foot. After approximately 40 hours of electrodialysis, the voltage is increased whereby chlorine is evolved at the anode and hydrogen is evolved at the cathode.

According to an alternative exemplification, electrolysis is carried out in a solid polymer electrolyte electrolytic cell where the anode and cathode are bonded to and embedded in the permionic membrane. The anode and cathode electrocatalyst are both particulate catalysts. The anode electrocatalyst may be a platinum group metal, a compound of a platinim group metal, an oxide of a platinum group metal, or an oxide of a platinum group metal with a transition metal, for example, ruthenium dioxide with titanium dioxide. Most commonly the anode electrocatalyst is a finely divided platinum group metal, a finely divided oxide of a platinim group metal, or a finely divided reduced oxide of a platinum group metal, as platinum black. The cathode electrocatalyst is similarly a finely divided particulate material as a platinum group metal, an oxide of a platinum group metal, or a reduced oxide of a platinum group metal. Most commonly the cathode is platinum black. As herein contemplated, the permionic membrane is installed in an electrolytic cell between suitable current collectors or current conductors, that is, between a pair of electrolyte-resistant, electrically conductive, porous conductors carrying electrical current from the current leads to the catalyst and thence from the catalyst on the opposite side of the permionic membrane—solid polymer electrolyte to the current leads. As herein contemplated, the permionic membrane is a methyl or ethyl ester of a perfluorinated carboxylic acid. The electrocatalyst particles are bonded to the permionic membrane while the permionic membrane is in a thermoplastic form, i.e. at a temperature of about 150 to about 230 degrees Centigrade, and compressed therein. Thereafter, the solid polymer electrolyte, still in the methyl or ethyl ester form, is installed in the electrolytic cell between the current collectors. Alkali metal chloride, for example, a 20 to 35 percent solution of potassium chloride is fed to the anolyte compartment of the solid polymer electrolyte electrolytic cell and a 5 to 45 weight percent potassium hydroxide solution is fed to the catholyte compartment of the electrolytic cell. Electrodialysis is then commenced at a current density of about 5 to 25 amperes per square foot, and a voltage below the combined sum of the electrode decomposition voltages, including overvoltage, and the electrolyte and membrane resistances, i.e., at a voltage of about 2.4 to 2.6 volts. Electrodialysis is maintained until the permionic membrane electrical resistivity has dropped from over 7 megaohm centimeter to under 7000 ohm-centimeter. Thereafter, the voltage is increased to a level to initiate electrolysis, i.e., to about about 2.9 to 3.1 volts whereby chlorine is evolved at the anode and recovered from the anolyte compartment, and hydrogen is evolved at the cathode, and potassium hydroxide in the catholyte liquor with hydrogen and potassium hydroxide being recovered from the catholyte compartment.

According to a still further exemplification of this invention, a permionic membrane electrolytic cell is provided having fingered metal anodes and fingered metal cathodes as described, for example, in U.S. Pat. No. 3,919,059. The permionic membrane is in the form of a methyl ester of a perfluorinated carboxylic acid. The permionic membrane is cut to the form of fingers and the fingers are then sealed by heat sealing to form a glove for the fingered cathode. Thereafter the fingered, permionic membrane glove, in the methyl ester form, is removed from the hot press and installed on the fingered cathode. The fingered cathode and complimentary fingered anode are assembled to form an electrolytic cell. Thereafter, 25 weight percent sodium chloride is fed to the anolyte compartment and 20 weight percent sodium hydroxide is fed to the catholyte compartment and an electrical potential of approximately 2.4 to 2.6 volts is maintained across the electrolytic cell. The electrodialytic current density is initially approximately 20 amperes per square foot, but gradually increases, over a period of about 48 hours to about 150 amperes per square foot at 2.6 volts. After the resistivity of the permionic membrane has been reduced from about 9 mega-ohm centimeters to about 5000 ohm-centimeters electrolysis is commenced by increasing the voltage from about 2.6 volts to about 3.3 volts.

The following examples are illustrative:

EXAMPLE I

A zero-gap permionic membrane electrolytic cell is assembled, the permionic membrane is hydrolyzed by a situ electrodialysis, and electrolysis is commenced.

A laboratory zero-gap permionic membrane cell is prepared. The cell is assembled from $\frac{5}{8}$ inch thick chlorinated polyvinyl chloride. The anolyte and catholyte compartments are each 3 inches by 3 inches by $\frac{7}{8}$ inch. The anode is a ruthenium dioxide coated, 20 mesh to the inch by 30 mesh to titanium screen. It is supported by a ruthenium dioxide coated, 2.5 mesh to the inch by 5 mesh to the inch, titanium back-up screen.

The cathode is a Raney-nickel coated, 20 mesh to the inch by 30 mesh to the inch nickel screen. It is backed up by a nickel plated 2.5 mesh to the inch by 5 mesh to the stainless steel screen.

The anode and cathode both bear upon the permionic membrane. The permionic membrane is a 11 mil thick ASAHI Glass FLEMION (TM) polymeric perfluorocarbon carboxylic acid membrane. It has an equivalent weight of 800 to 1200 grams, and is in the ethyl ester form.

After assembly, brine containing 26 weight percent sodium chloride is fed to the anolyte compartment and 26 weight percent sodium hydroxide is fed to the catholyte compartment. An electrical potential of 2.47 volts is imposed across the cell, which is less than the combined electrode potentials and membrane voltage drop. This voltage is maintained for 10 minutes, causing electrodialysis to occur at approximately 50 amperes per square foot. Thereafter, the voltage is increased to 2.65 volts, causing electrodialysis to occur at 100 amperes per square foot.

Electrolysis is commenced after electrodialysis.

EXAMPLE II

A permionic membrane electrolytic cell was assembled, the permionic membrane was hydrolyzed by in situ electrodialysis, and electrolysis was commenced.

A laboratory permionic membrane electrolyte cell was assembled from $\frac{5}{8}$ inch thick chlorinated polyvinyl chloride. The anolyte and catholyte compartments are each 5 inch by 7 inch by $\frac{7}{8}$ inch. The anode was an Englehard platinum-iridium coated titanium mesh anode having 2.5 mesh to the inch by 5 mesh per inch. The cathode was a flame sprayed Raney nickel and molybdenum surface on a nickel coated steel mesh substrate, having 2.5 mesh to the inch by 5 mesh to the inch. The anode to cathode gap was approximately one-quarter inch.

The initial charge to the anolyte compartment was of 17 weight percent sodium chloride at a pH of 8.1. The initial charge to the catholyte compartment was 25 weight percent sodium hydroxide.

The brine feed to the cell was 9.5 cubic centimeters per minute of 26 weight percent sodium chloride and 5.9 cubic centimeters per minute, providing a 17 weight percent, pH 8.1 brine feed.

The cell was charged with the initial charges, and over a period of approximately 3 hours the anolyte overflow pH dropped from pH 8.1 to pH 7.5, and the resistivity of the permionic membrane dropped to 30,000 ohm-centimeters. Thereafter brine feed and feed of 25 weight percent caustic soda were started. After 25 minutes the resistance of the permionic membrane was 4200 ohm-centimeters.

Thereafter, an electrical potential of 2.48 volts was imposed across the cell, yielding an electrodialysis current density of about 5 amperes per square foot. After approximately 37 minutes the electrical potential was increased to 2.61 volts, yielding an electrodialysis current density of 16 amperes per square foot. After about 50 minutes the voltage was increased to 2.62 volts, yielding an electrodialysis current density of 24 amperes per square foot.

Thereafter, the rectifier was set on a constant current of 24 amperes per square foot for 16 hours. After 16 hours the cell voltage was 2.91 volts.

Thereafter, the brine feed was changed to 9.5 cubic centimeters per minute of 26 weight percent sodium chloride, the catholyte feed was changed to 0.72 cubic centimeters per minute of water.

Electrolysis was commenced. Over a period of two hours, the voltage increased from 2.51 volts at 42 amperes per square foot to 3.07 volts at 180 amperes per square foot.

While the invention has been described with respect with certain exemplifications and embodiments thereof, the scope of protection is not intended to be limited thereby but only the claims appended hereto.

I claim:

1. In a method of operating an electrolytic cell having an anolyte compartment with an anode therein, a catholyte compartment with a cathode therein, and a cation selective permionic membrane therebetween, said cation selective permionic membrane comprising a polymeric perfluorocarbon having pendant functional groups, said functional groups being in the alkali metal salt form during electrolysis, which method comprises feeding alkali metal chloride brine to the anolyte compartment, passing an electrical current through the cell, and evolving chlorine at the anode, the improvement comprising:

(1) providing alkali metal chloride brine in the anolyte compartment, and an electrolyte in the catholyte compartment:

(2) maintaining an electrodialytic electrical potential between the anode and the cathode until the current density attains an electrolytic current density: and (3) thereafter increasing the electrical potential therebetween whereby to initiate electrolysis.

2. The method of claim 1 comprising maintaining the electrodialytic electrical potential high enough to acidify to the anolyte but low enough to avoid substantial electrode product evolution.

3. In a method of operating an electrolytic cell having an anolyte compartment with an anode therein, a catholyte compartment with a cathode therein, and a cation selective permionic membrane therebetween, said cation selective permionic membrane comprising a polymeric perfluorocarbon having pendant functional groups, said functional groups being in the alkali metal salt form during electrolysis, which method comprises feeding alkali metal chloride brine to the anolyte compartment, passing an electrical current through the cell and evolving chlorine at the anode, the improvement comprising:

(1) providing alkali metal chloride brine in the anolyte compartment, and an electrolyte in the catholyte compartment;

(2) establishing an electrical potential between the anode and the cathode to acidify the anolyte liquor while maintaining the potential low enough to avoid production of electrode product until the permionic membrane is substantially hydrolyzed; and (3) thereafter increasing the electrical potential therebetween whereby to initiate electrolysis.

4. The method of claim 3 comprising maintaining the electrical potential low enough to avoid the production of electrode product while the electrical resistance of the permionic membrane is decreasing, and increasing the electrical potential after the electrical resistance attains a substantially constant value.

* * * * *